US010604397B2

(12) United States Patent
Bernede et al.

(10) Patent No.: US 10,604,397 B2
(45) Date of Patent: Mar. 31, 2020

(54) BEVERAGE DISPENSING MODULE WITH ACTIVATION SYSTEM FOR A PRESSURING ROLLER

(71) Applicant: Pernod Ricard SA, Paris (FR)

(72) Inventors: Gilles Bernede, Paris (FR); Emilie Heurtaux, Paris (FR)

(73) Assignee: Pernod Ricard SA, Paris (FR)

( * ) Notice: Subject to any disclaimer, the term of this patent is extended or adjusted under 35 U.S.C. 154(b) by 0 days.

(21) Appl. No.: 16/094,031

(22) PCT Filed: Apr. 13, 2017

(86) PCT No.: PCT/EP2017/059032

§ 371 (c)(1),
(2) Date: Oct. 16, 2018

(87) PCT Pub. No.: WO2017/182400

PCT Pub. Date: Oct. 26, 2017

(65) Prior Publication Data

US 2019/0112175 A1 Apr. 18, 2019

(30) Foreign Application Priority Data

Apr. 18, 2016 (GB) ..... 1606710.0

(51) Int. Cl.
*B67D 1/00* (2006.01)

(52) U.S. Cl.
CPC ..... *B67D 1/0004* (2013.01); *B67D 1/0001* (2013.01); *B67D 1/0079* (2013.01)

(58) Field of Classification Search
CPC ... B67D 1/0004; B67D 1/0001; B67D 1/0079
USPC ..... 222/101, 105, 106
See application file for complete search history.

(56) References Cited

U.S. PATENT DOCUMENTS 5,490,613 A * 2/1996 Taylor ..... A47K 5/1215 222/102
6,135,320 A * 10/2000 Parsons ..... A47K 5/1211 222/214
6,196,420 B1 * 3/2001 Gutierrez ..... B67D 1/0001 222/101

(Continued)

FOREIGN PATENT DOCUMENTS

EP 1214269 B1 12/2003
WO 0142090 A2 6/2001

(Continued)

*Primary Examiner* — Lien M Ngo
(74) *Attorney, Agent, or Firm* — GableGotwals

(57) ABSTRACT

The module comprises a deformable beverage container and a dispensing arrangement within a housing. The module further comprises a beverage outlet arrangement fluidly coupled with the beverage container. The dispensing arrangement has a pressurizing roller for selectively urging beverage from the beverage container and out of the beverage outlet arrangement. The module further comprises a securing arrangement having a securing device that is actuatable between a first configuration and a second configuration. The first configuration is for maintaining the pressurizing roller in a storage position relative to the beverage container and the second configuration is for releasing the pressurizing roller from the storage position.

18 Claims, 14 Drawing Sheets

(56) References Cited

U.S. PATENT DOCUMENTS

| | | | | |
|---|---|---|---|---|
| 6,691,894 | B2 * | 2/2004 | Chrisman | B67D 1/0001 222/101 |
| 10,264,926 | B2 * | 4/2019 | Ciavarella | A47K 5/122 |
| 2004/0216427 | A1 | 11/2004 | Schroeder et al. | |
| 2013/0240562 | A1 | 9/2013 | Middleton | |
| 2014/0008390 | A1 * | 1/2014 | Burke | B67D 7/0216 222/101 |

FOREIGN PATENT DOCUMENTS

| | | | |
|---|---|---|---|
| WO | 02092462 | A1 | 11/2002 |
| WO | 2007084054 | A1 | 7/2007 |

* cited by examiner

BEVERAGE DISPENSING MODULE WITH ACTIVATION SYSTEM FOR A PRESSURING ROLLER

CROSS-REFERENCE TO RELATED APPLICATIONS

This application is the United States National Phase of Patent Application No. PCT/EP2017/059032 filed 13 Apr. 2017, which claims priority to British Patent Application Nos. 1606710.0 filed 18 Apr. 2016, each of which are incorporated herein by reference.

BACKGROUND OF THE INVENTION

Technical Field

This invention is directed towards a beverage dispensing module and in particular an activation system therefor. The beverage dispensing module is particularly suitable for alcoholic beverages.

Background

Beverages, for example alcoholic beverages, sodas, concentrates and the like, are commonly supplied individually to consumers in bottles and typically glass bottles. However, glass bottles utilise space inefficiently when stacked, are relatively heavy and can be broken relatively easily when subjected to an impact. Therefore, they are not optimally suited to transportation. Furthermore, when a bottle is opened air is able to contact the beverage, which may result in the evaporation of the beverage and/or causing the beverage to degrade. For example, the alcohol in an alcoholic beverage will evaporate, thereby reducing the alcoholic content of the beverage. The air may also oxidise the alcohol such that the taste of the beverage changes.

Bag-in-box type containers commonly prevent air from contacting the beverage by comprising a one-way valve which allows beverage to flow out of, but prevents air from flowing into, the bag. However, such bag-in-box containers are not considered to be premium products by consumers and have, as a result, not replaced glass bottles as the typical beverage container. The bag-in-box type containers are also commonly very large (e.g. 3 to 5 litres) and are not suited to storing beverages, such as liquors, which are commonly supplied only in relatively smaller quantities (e.g. 1 litre).

WO-A-2015/101573 and WO-A-2015/101571 disclose beverage dispensing modules having dispensing means. However, a particular problem associated with such beverage dispensing means is accidental actuation of the dispensing means during storage or in transit.

SUMMARY OF INVENTION

The present invention seeks to address at least the above problem. In accordance with a first aspect of the present invention there is provided a beverage dispensing module as set out in claim 1. In accordance with a second aspect of the present invention there is provided a method of initiating the dispensing of a beverage from a beverage dispensing module as set out in claim 17.

The present invention provides several benefits. For example, by providing a securing arrangement for selectively holding and releasing the pressurising means, the module may be shipped, stored and sold in a condition whereby accidental or deliberate actuation of the dispensing means will not result in dispensing of the beverage. In particular, holding the pressurising means prevents the pressurising means from generating the overpressure upon the beverage container when it is not necessary. Furthermore, the securing arrangement may be configured such that its operation is visible to a user. Therefore, a user is able to determine that the module has already been used and/or tampered with.

The beverage dispensing module is suitable for containing alcoholic beverages and is particularly suitable for containing spirits, such as whisky, vodka, gin, liqueur, coffee liqueur, rum, aniseed-based spirit, pastis, cognac, brandy or tequila. The beverage dispensing module may also be suitable for containing other alcoholic beverages including champagne, wine, beer or cocktails, and/or other types of beverage, including sodas (also known as soft drinks) and beverage concentrates.

DETAILED DESCRIPTION

Figure 1:
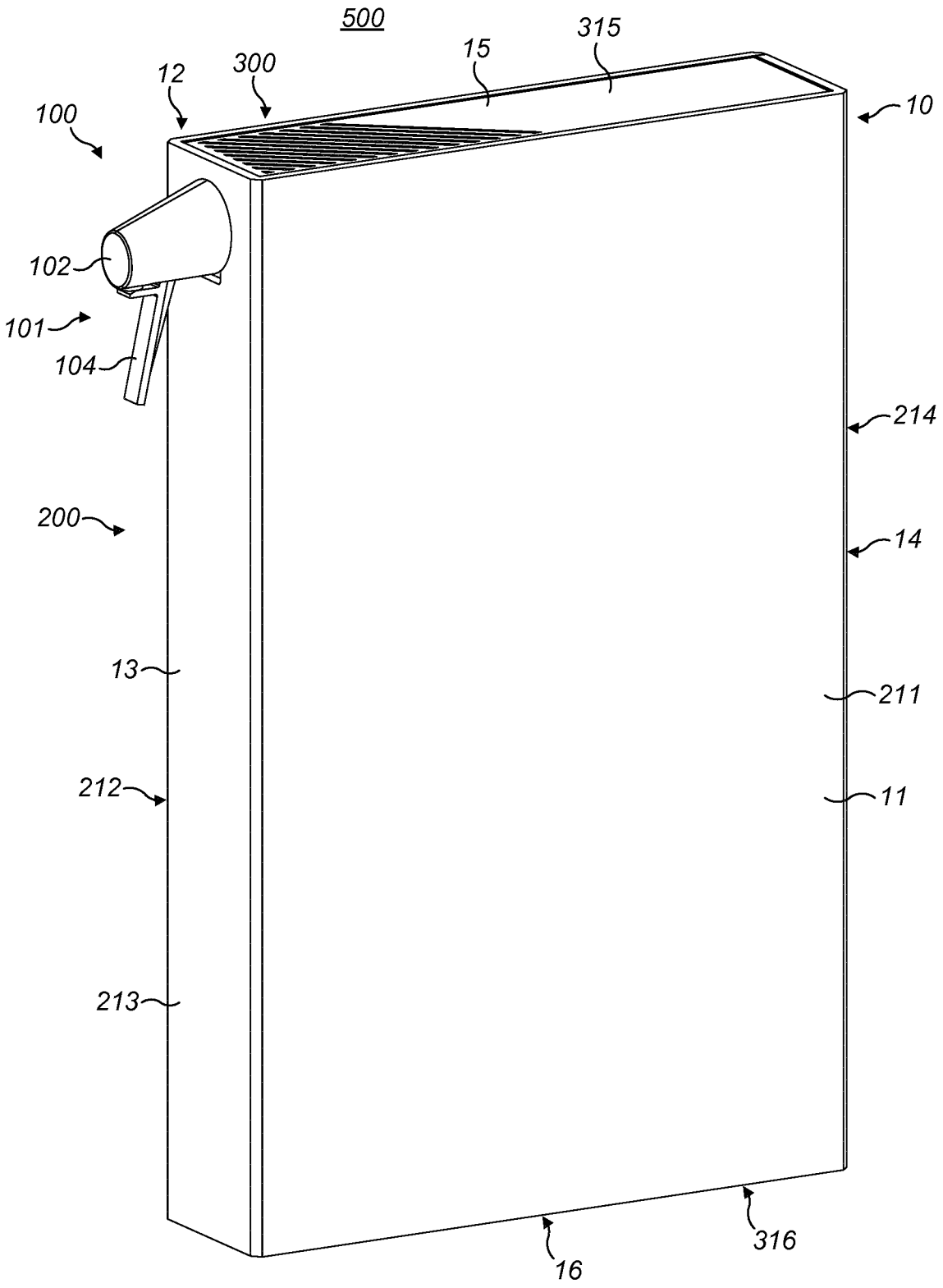
FIG. 1 is a perspective view of a beverage dispensing module in accordance with a first embodiment of the invention, the beverage dispensing module of FIG. 1 including a housing having an outer cover and a frame.

FIGS. 1 to 4 illustrate an embodiment of the present invention in which a beverage dispensing module 500 is operable to stand on a surface independently and is generally bibliomorphic (book shaped). The module 500 comprises a housing 10, a beverage container 112 within the housing 10, a beverage outlet arrangement 101 for enabling dispensing of beverage from the beverage container 112 and a dispensing arrangement 100 configured to dispense beverage from the beverage container 112 when the beverage outlet arrangement 101 is open.

The housing 10 comprises first and second major side walls 11, 12, first and second minor side walls 13, 14 and top 15 and bottom walls 16. In the present disclosure the term "minor" is used to indicate a small dimension (e.g. area or length) and the term "major" is used to indicate a larger dimension. For example, the surface area of each of the first and second major side walls 11, 12 is larger than the surface area of each of the first and second minor side walls 13, 14.

As illustrated in FIG. 1 the walls 11, 12, 13, 14, 15, 16 are each substantially rectangular in shape. Each major edge of the first and second major side walls 11, 12 is coincident with a major edge of the first or second minor side wall 13, 14. Each minor edge of the first and second major side walls 11, 12 is coincident with a major edge of the top and bottom walls 15, 16. Each minor edge of the first and second minor side walls 13, 14 is coincident with a minor edge of the top and bottom walls 15, 16. The housing 10 therefore has a substantially rectangular cuboidal shape and is, in a particularly preferred arrangement, of a height, width and depth such as to provide an upright beverage module 500 which is both capable of being freestanding and is also relatively stable in that configuration.

The housing 10 can be in any suitable configuration, particular suitable configurations are shown in FIGS. 1 to 4 where the housing 10 comprises a cover 200 and a frame 300.

The cover 200 of the housing 10 comprises first and second major side cover panels 211, 212, and first and second minor side cover panels 213, 214. The cover panels 211, 212, 213, 214 are each substantially rectangular in shape. Each major edge of the first and second major side cover panels 211, 212 is coincident with a major edge of the first or second minor side cover panels 213, 214. Each minor edge of the first and second major side cover panels 211, 212 is a free edge. Each minor edge of the first and second minor side cover panels 213, 214 is a free edge. The cover 200 therefore has a substantially rectangular cuboidal shape.

The frame 300 of the housing 10 comprises first and second major side frame panels 311, 312, first and second minor side frame panels 313, 314 and top 315 and bottom frame panels 316. The frame panels 311, 312, 313, 314, 315, 316 are each substantially rectangular in shape. Each major edge of the first and second major side frame panels 311, 312 is coincident with a major edge of the first or second minor side frame panels 313, 314. Each minor edge of the first and second major side frame panels 311, 312 is coincident with a major edge of the top and bottom frame panels 315, 316. Each minor edge of the first and second minor side frame panels 313, 314 is coincident with a minor edge of the top and bottom frame panels 315, 316. The frame 300 therefore has a substantially rectangular cuboidal shape.

The first and second major side frame panels 311, 312 comprise at least one annular groove 317 on an outer surface thereof. The annular groove 317 may assist in preventing the major side walls 11, 12 from bulging outwards when placed under force from the beverage container 112 therein as will be discussed in further detail below.

Figure 2:
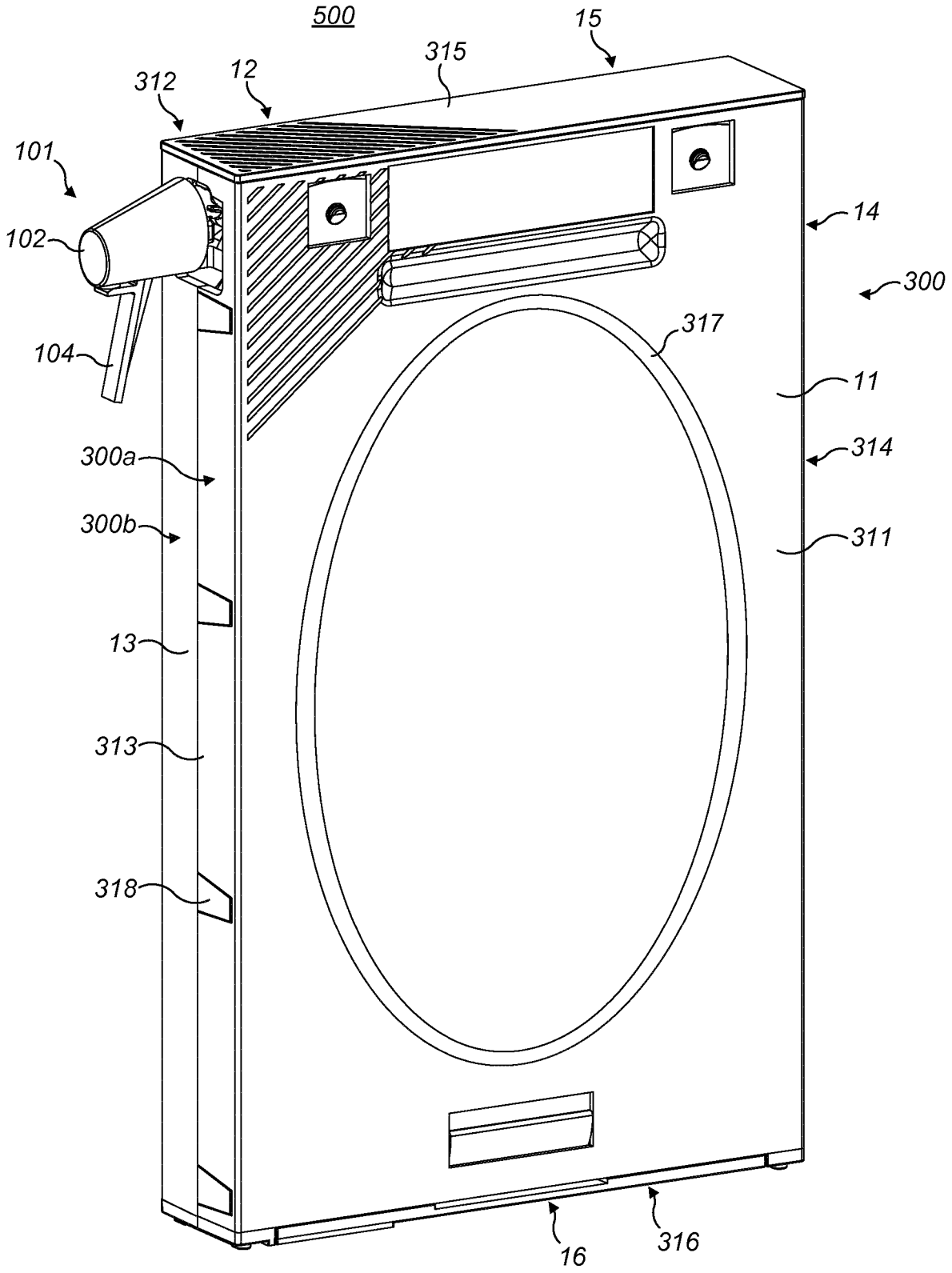
FIG. 2 is a perspective view of the beverage dispensing module of FIG. 1 with the outer cover hidden.
Figure 3:
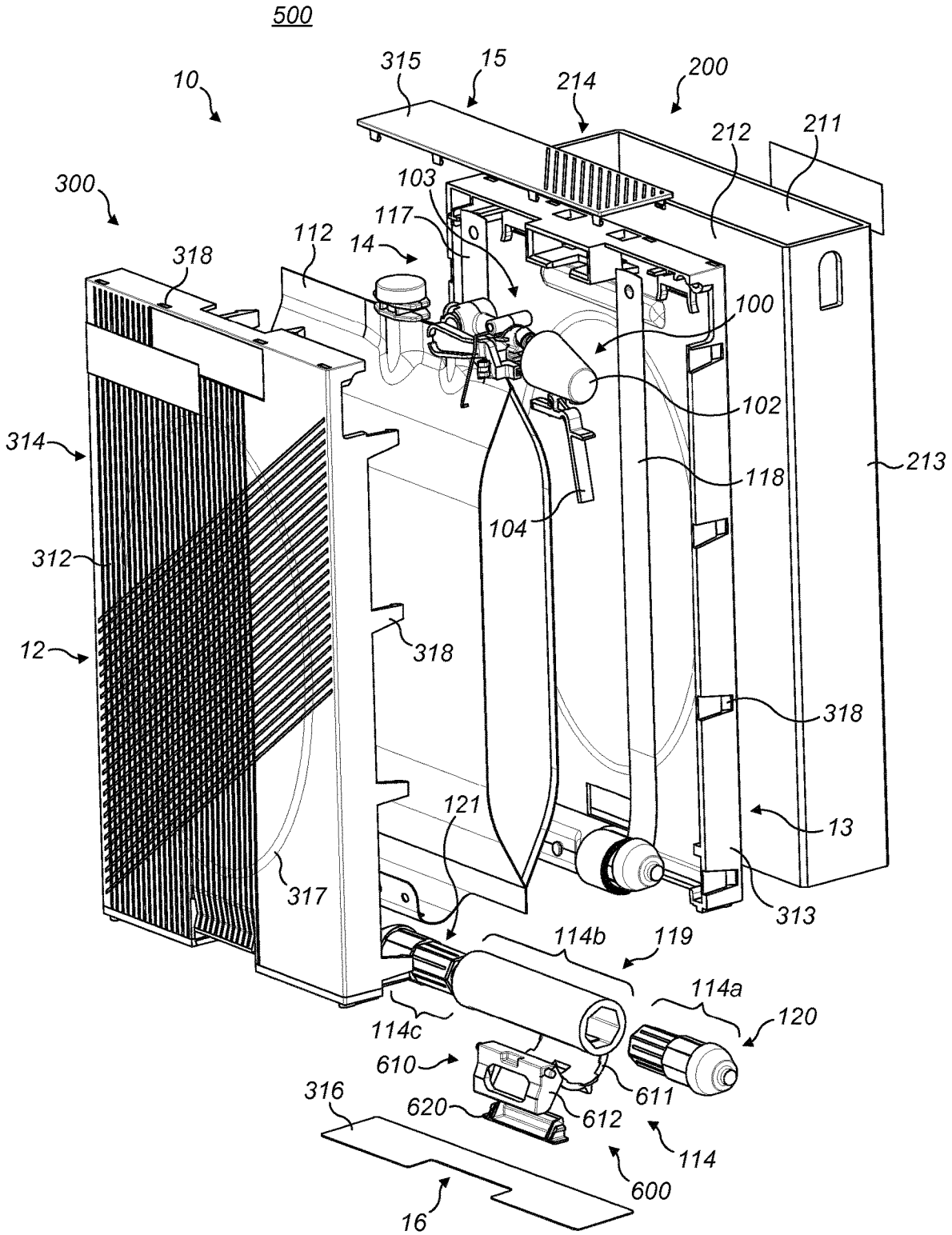
FIG. 3 is an exploded view of parts of the beverage dispensing module of FIG. 1.
Figure 4:
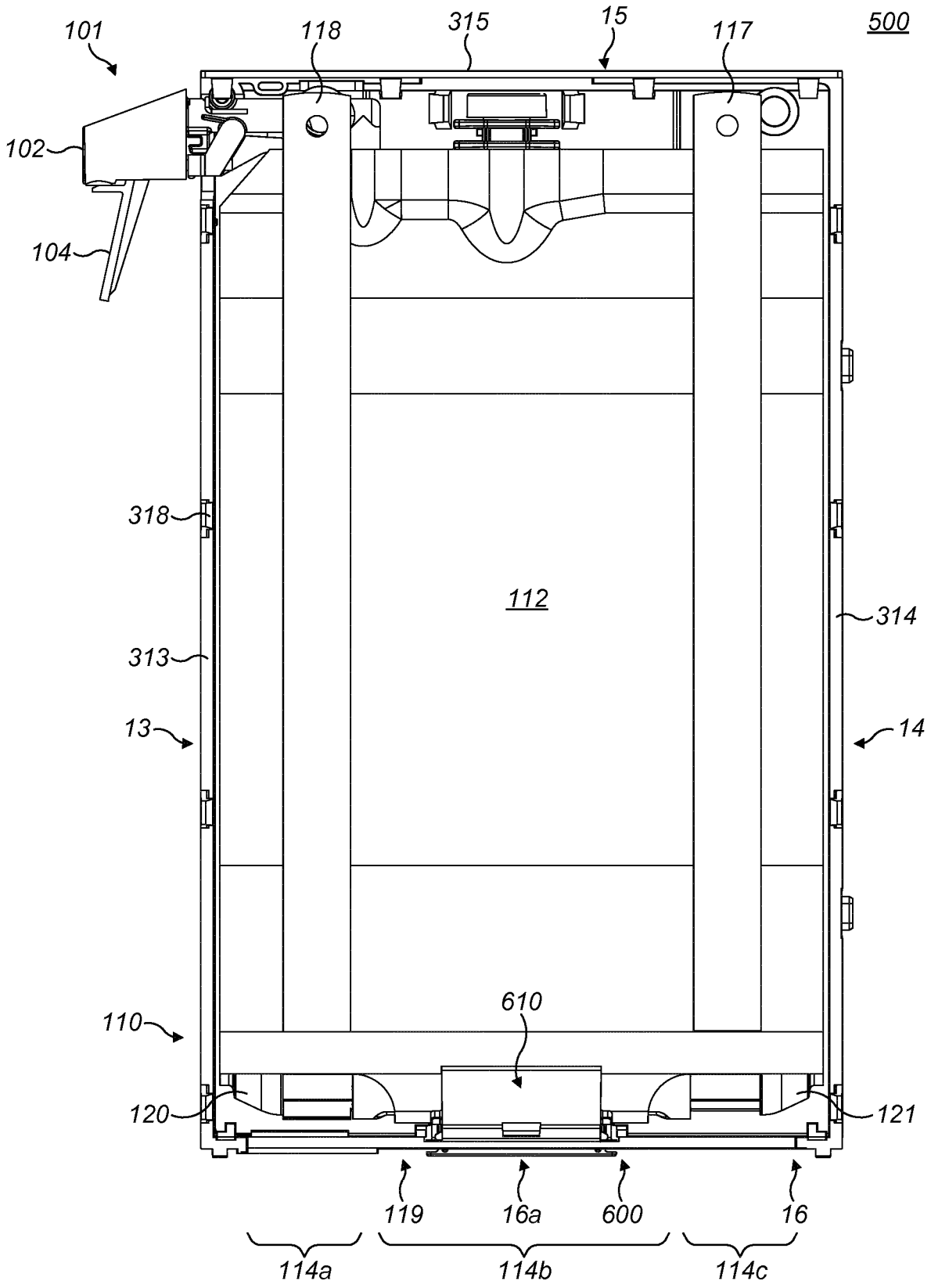
FIG. 4 is a side view of the beverage dispensing module of FIG. 1, with a major wall of the housing hidden.

As best seen in FIGS. 2 and 3, the frame 300 of the housing 10 is formed of first and second sections 300*a*, 300*b*. The first section 300*a* comprises the first major side frame panel 311 and the second section 300*b* comprises the second major side frame panel 312. Extending from the periphery of the first major side frame panel 311, the second major side frame panel 312 and the top frame panel 315 are complementary locking features 318 facilitating connection of the frame 300. The complementary locking features 318 may comprise tabs extending from one of the major side frame panels 311, 312 in a direction orthogonal to the plane of the major side frame panels 311, 312 and corresponding grooves within the other major side frame panel 311, 312. When the first and second sections 300*a*, 300*b* are combined together, the complementary locking features 318 may form the first and second minor side frame panels 313, 314.

The complementary locking features 318 may also comprise tabs extending from the periphery of the top frame panel 315 in a direction orthogonal to the plane of the top frame panel 315. The complementary locking features 318 may further comprise corresponding slots extending from the top minor edge of the first and second major side frame panels 311, 312 in a direction parallel to the plane of the major side frame panels 311, 312. The bottom frame panel 316 may be glued or otherwise bonded to the bottom minor edges of the major side frame panels 311, 312.

The interaction between the complementary locking features 318 ensures that the frame 300 remains in place when the module 500 is constructed, but also prevents the major side frame panels 311, 312 from bulging outwards when placed under force from the beverage container 112 therein. The complementary locking features 318 also facilitate opening of the frame 300 to enable separation of the frame 300 from the beverage container 112 during disassembly by a user. Furthermore, the complementary locking features 318 between the top frame panel 315 and the major side frame panels 311, 312 enables the top frame panel 315 to be separated from the remainder of the frame 300 of the housing 10 to facilitate recycling of each since they may be formed of different materials.

When the cover 200 and the frame 300 of the housing 10 are combined together: the first major side cover panel 211 and the first major side frame panel 311 form the first major side wall 11 of the housing 10; the second major side cover panel 212 and the second major side frame panel 312 form the second major side wall 12 of the housing 10; the first minor side cover panel 213 and the first minor side frame panel 313 form the first minor side wall 13 of the housing 10; the second minor side cover panel 214 and the second minor side frame panel 314 form the second minor side wall 14 of the housing 10; the top frame panel 315 forms the top wall 15 of the housing 10 and the bottom frame panel 316 forms the bottom wall 16 of the housing 10.

The structural support provided by the frame 300 of the housing 10 enables a plurality of modules 500 to be stacked adjacent to and/or on top of one another. Stacking efficiency is thereby achieved by the saving of space during stacking.

The beverage outlet arrangement 101 is configured to control liquid beverage flow or selectively dispensing liquid beverage from the beverage container 112 located within the housing 10. The beverage outlet arrangement 101 comprises an outlet nozzle 102 mounted to the outside of the housing 10 and a beverage dispensing valve 103 located at least partially within the housing 10. The beverage dispensing valve 103 is manually opened and closed by a dispensing actuator 104.

The beverage container 112 may comprise a beverage reservoir. The beverage reservoir may be a pouch and may, in use, contain alcoholic beverage. The pouch 112 is sealed to the beverage outlet arrangement 101 of the dispensing arrangement 100. The pouch 112 is preferably formed from a substantially flexible, impermeable, laminar membrane. The laminate is preferably of a type suitable for containing alcoholic beverage and thus withstands exposure to alcohol for a significantly long period of time and does not degrade or delaminate. The laminate may comprise at least one metallised layer and at least one weld layer. The laminate may comprise a number of layers of PE (polyethylene), PET (polyethylene terephthalate), PETMET (PET metallised with a metal, such as aluminium, of negligible thickness), aluminium (referred to as ALU), EVOH (Ethylene vinyl alcohol), PP (polypropene), OPA (polyamide), silicon oxide and aluminium oxide.

The dispensing arrangement 100 also comprises a pressurising means 110 comprising a roller 114 and roll springs 117, 118. The pressurizing means 110 is preferably housed or located substantially entirely within the housing 10. As will be described in further detail below in connection with FIGS. 4 to 8, the bottom end of the pouch 112 (that is, the end of the pouch 112 away from the beverage outlet arrangement 101) is attached to the roller 114. The roller 114 is in turn connected via the roll springs 117, 118 to the housing 10. The force created by the stored energy in the roll springs 117, 118 urges the roller 114 in an upward direction, so as to create a slight overpressure upon the alcoholic beverage within the pouch 112. The roll springs 117, 118 are preferably constant force roll springs.

The beverage dispensing valve 103 is formed within the dispensing arrangement 100 and prevents the alcoholic beverage from flowing out of the module 500 when in a closed position, whilst at the same time preventing ingress of air into the pouch 112. The valve 103 is fluidly connected to an outlet formed in or on an upper edge of the pouch 112, via a flexible connecting conduit. In use, when the dispensing actuator 104 is depressed, the beverage dispensing valve 103 is caused to open. Beverage then flows out of the pouch 112, along the flexible conduit, through the valve 103, and out of the outlet nozzle 102. This is a result of the overpressure within the pouch 112 caused by the upwards force provided by the roll springs 117, 118, and the roller 114. Beverage continues to flow until the dispensing actuator 104 is released, whereupon the valve 103 closes and prevents further fluid flow out of the module 500.

The roller 114 may be formed from any suitable material, such as cardboard. The roller 114 preferably comprises a tubular body 119 and extends between a first end 120, proximal to the first minor side wall 13, and a second end 121, proximal to the second minor side wall 14. The roller 114 comprises first and second parts 114*a*, 114*c* each forming the first and second ends 120, 121 and an intermediate part 114*b* located or mounted between the first and second parts 114*a*, 114*c*. The first and second parts 114*a*, 114*c* are mounted within an internal passageway of the intermediate part 114*b*, which may be a hollow cylinder. Such an arrangement is advantageous as the ease of construction and assembly of the module 500 is improved and the weight of the module 500 reduced.

The lower end of the pouch 112 is attached to the intermediate part 114*b* of the roller 114. The width of the pouch 112 at its lower end is substantially the same as the length of the intermediate part 114*b* of the roller 114. The width of the pouch 112 subsequently increases to extend between the first minor side wall 13 and the second minor side wall 14 of the housing 10.

The roll springs 117, 118 are mounted on the roller 114 in recesses or steps around the outer circumference of the first and second parts 114*a*, 114*c* of the roller 114. The roll springs 117, 118 store mechanical energy such that they will apply a rotational force to the roller 114. The free end of each spring 117, 118 extends from the roller 114 to the top of the housing 10 where it is attached to the housing 10 within a recess on an inner surface of one of the major side walls 11, 12 of the housing 10. The free ends of the springs 117, 118 extend to the top of the housing 10 between the pouch 112 and one of the major side walls 11, 12 of the housing 10. When the roller 114 reaches the top of its range and the pouch 112 has entirely wrapped around it, the provision of the springs 117, 118 in the recesses has been found to ensure that there is less residual beverage left in the pouch 112. This is due to the avoidance of shoulders or steps between the springs 117, 118 and the edge of the roller 114.

The roller 114 may be secured to the housing 10 in a storage position by a securing arrangement 600. The storage position is proximal to the bottom wall 16 of the housing 10 and selected such that the roller 114 does not create an overpressure upon the alcoholic beverage within the pouch 112. The securing arrangement 600 comprises a securing device 610 that is actuatable between a first configuration (as in FIGS. 4, 5, 6, 7, 8A, 8B, 9A, 9B), for maintaining the roller 114 in the storage position, and a second configuration (as in FIGS. 8C, 8D,9C), for releasing the roller 114 from the storage position.

Figure 5:
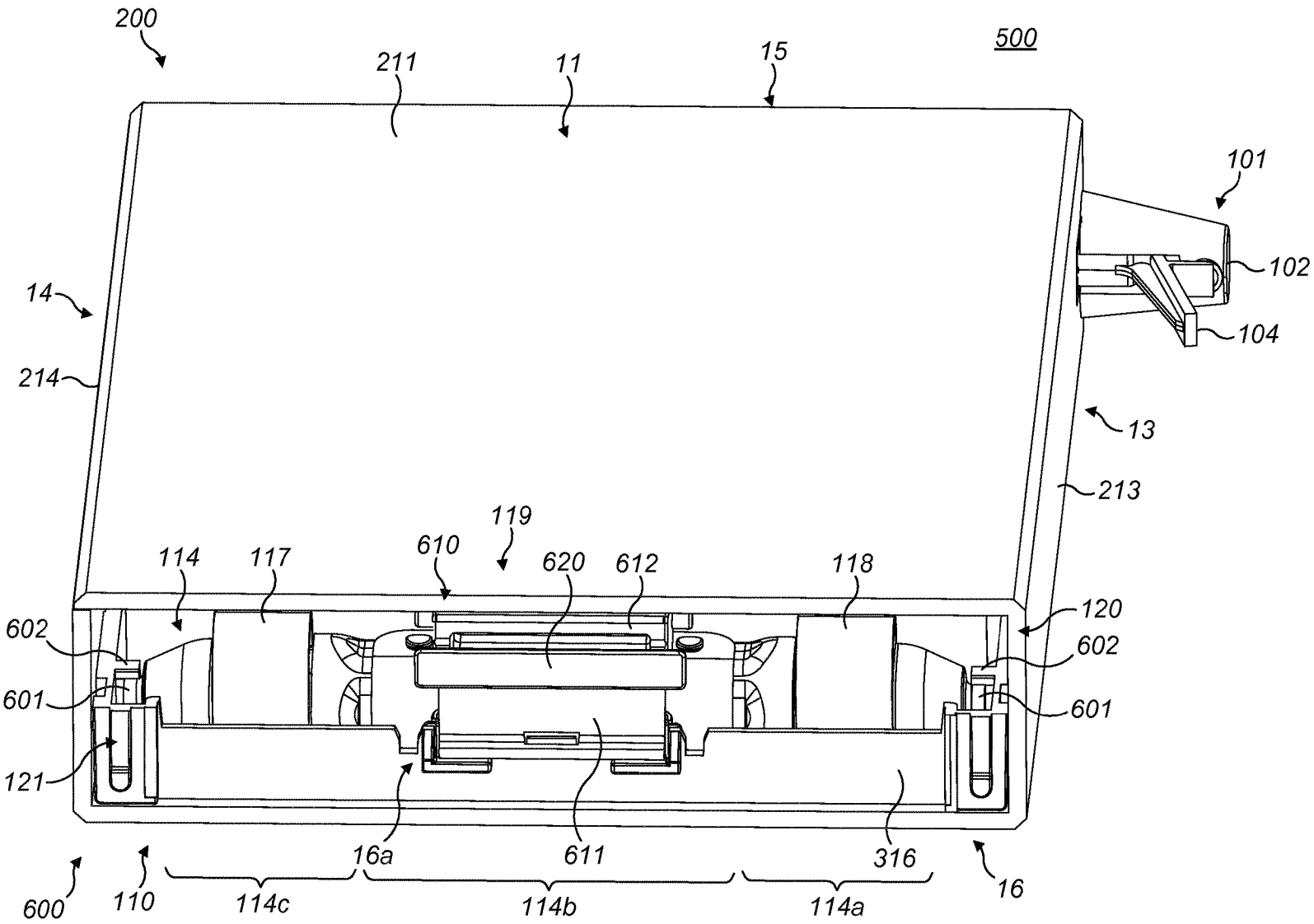
FIG. 5 is a further perspective view of the underside of the beverage dispensing module of FIG. 1 with a bottom wall of the housing partially hidden.
Figure 6:
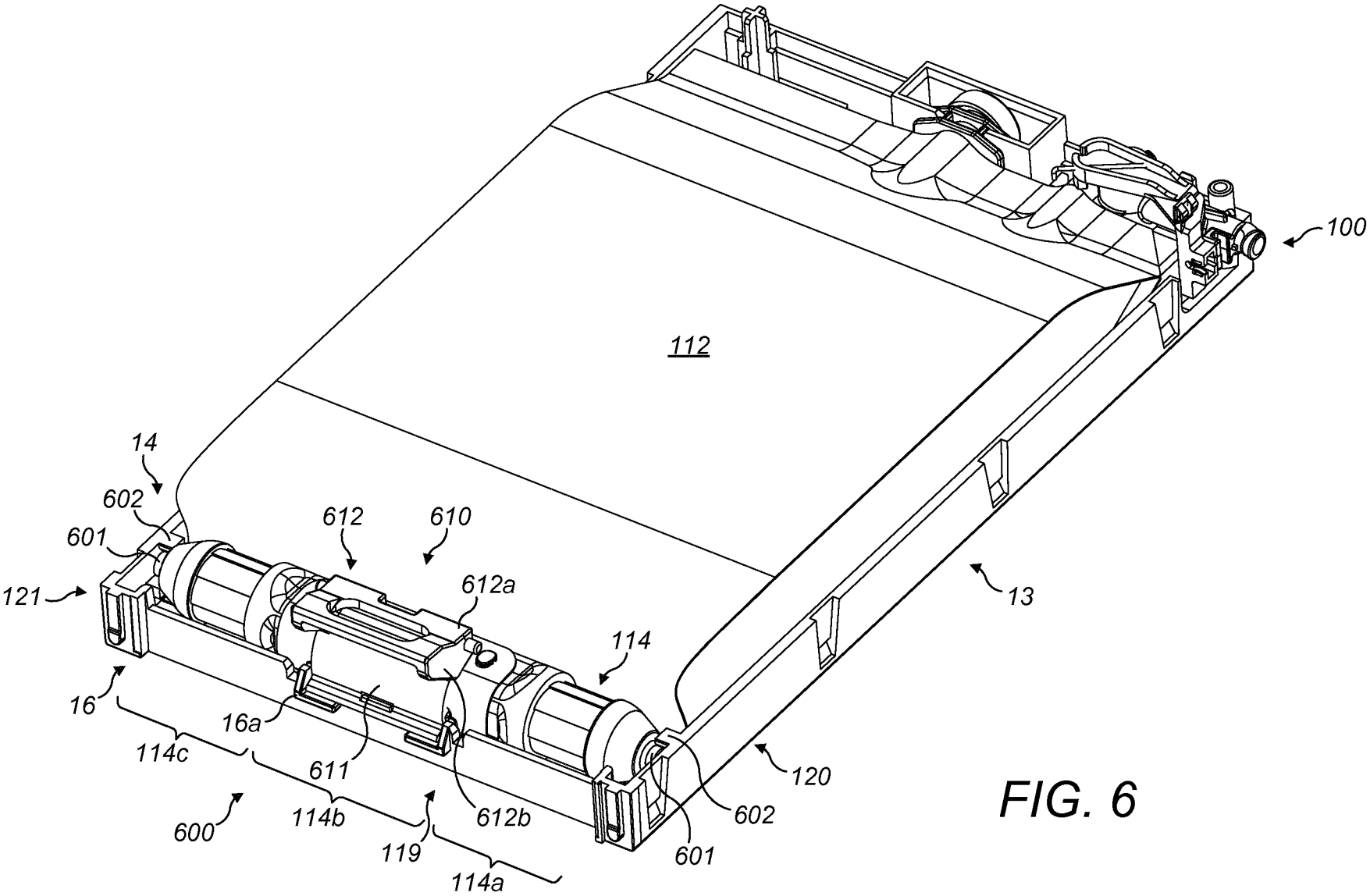
FIG. 6 is a further perspective view of the beverage dispensing module of FIG. 1 with a major wall of the housing hidden.

FIGS. 5 and 6 show the module 500 with the roller 114 maintained in the storage position by the securing arrangement 600. The securing arrangement 600 comprises first engagement means 601, which may be protruding sections extending from the first 120 and second ends 121 of the roller 114. The securing arrangement 600 further comprises second engagement means 602 fixed relative to the housing 10. The second engagement means 602 may comprise stop members that extend from inner surfaces of the minor side walls 13, 14 and are proximal to the bottom wall 16 of the housing 10. The first and second engagement means 601, 602 engage with one another to hold the roller 114 in the storage position. In particular, the stop members abut top surfaces of the protruding sections when the roller 114 is in the storage position and so prevent movement of the roller 114 in an upward direction.

The securing device 610 comprises a holding portion 611 for holding the roller 114 in the storage position. The holding portion 611 may be semiannular and extend in a direction parallel to the major edge of the bottom wall 16. The holding portion 611 may surround an outer circumference of the intermediate part 114*b* of the roller 114. More specifically, in the first configuration, the holding portion 611 surrounds a lower portion of the outer circumference of the intermediate part 114*b* of the roller 114 and so is positioned between the roller 114 and the minor side walls 13, 14 and the bottom wall 16. In the first configuration, the holding portion 611 exerts a retaining force on the roller 114 that opposes a releasing force of the roll springs 117, 118 to maintain the roller 114 in the storage position. The retaining force is exerted in a radial direction of the roller 114 towards the centre of the roller 114.

The securing device 610 also comprises a handle 612 extending between a first end 612*a* and a second end 612*b*. In the first configuration, the handle 612 is positioned between the roller 114 and the second major side wall 12. The first end 612*a* of the handle 612 is mounted to the holding portion 611 and, when in the first configuration, the second end 612*b* of the handle 612 is positioned in line with an opening 16*a* in the bottom wall 16 of the housing 10. The second end 612*b* of the handle 612 is accessible from outside the housing 10 through this opening 16*a*.

Figure 7:
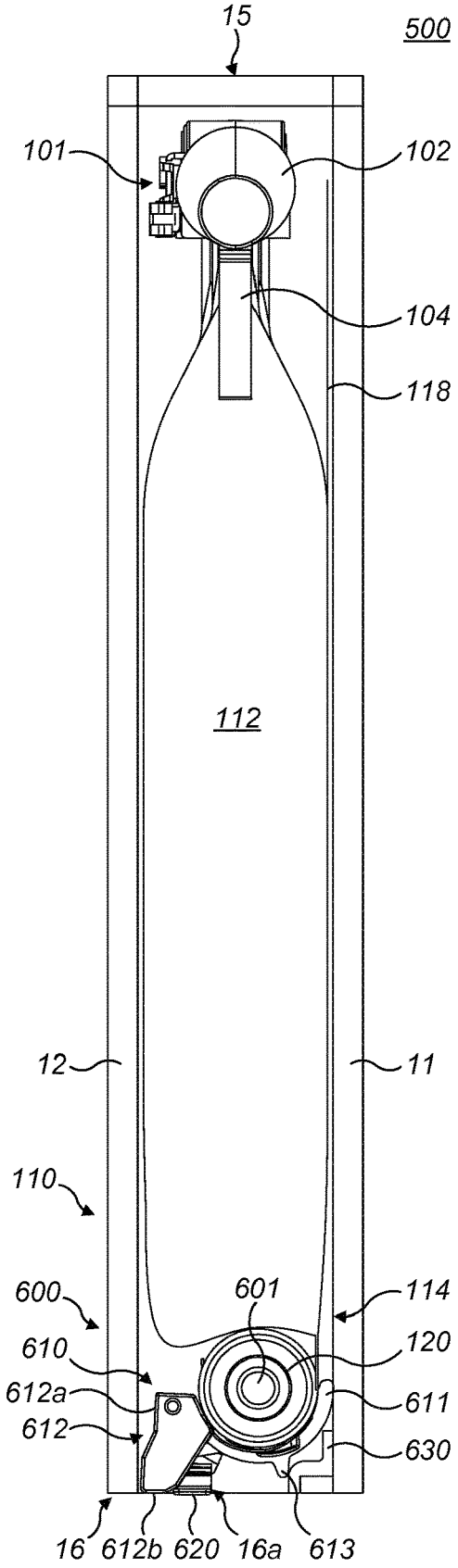
FIG. 7 is a view of the front of the beverage dispensing module of FIG. 1 with a minor wall of the housing hidden.

As shown in FIG. 7, a pivot body 613 may project from an outer surface of the holding portion 611 towards the bottom wall 16 of the housing 10. The pivot body 613 may extend along the holding portion 611 in a direction parallel to the major edge of the bottom wall 16.

The securing arrangement 600 further comprises fixing means 620 for fixing the securing device 610 relative to the housing 10 in the first configuration. The fixing means 620 may comprise a removable wedge wedged between the securing device 610 and the housing 10. The removable wedge 620 is positioned adjacent to the opening 16*a* in the bottom wall 16 of the housing 10 and so is accessible from outside the housing 10 through this opening 16*a*. More specifically, the removable wedge 620 may be wedged between the handle 612 and the holding portion 611 of the securing device 610. The removable wedge 620 maintains the handle 612 within the housing 10 of the module 500 and prevents the pivot body 613 from contacting the bottom wall 16 of the housing 10.

The fixing means 620 may comprise a temporary locking means to lock the fixing means 620 in place before removal by a user. The temporary locking means may comprise two hooks that hook to an inner surface of the bottom wall 16 surrounding the opening 16*a*. The temporary locking means may be removed by application of a suitable force by a user.

The securing arrangement 600 may further comprise a stop portion 630 that abuts the first major side wall 11 of the housing 10 and the pivot body 613 of the securing device 610 so as to prevent the holding portion 611 from moving towards the first major wall 11, particularly during actuation from the first to the second configuration.

During storage and transport of the module 500, the fixing means 620 is kept in place such that the securing device 610 cannot move. This prevents the beverage from being dispensed, because the roller 114 is tethered to the housing 10 in the storage position and thus prevented from pressurising the pouch 112. To initiate use of the module 500 and permit beverage to be dispensed, the roller 114 must be released from the storage position. The steps involved are shown in FIGS. 8A to 8D and 9A to 9C.

Figure 8A:
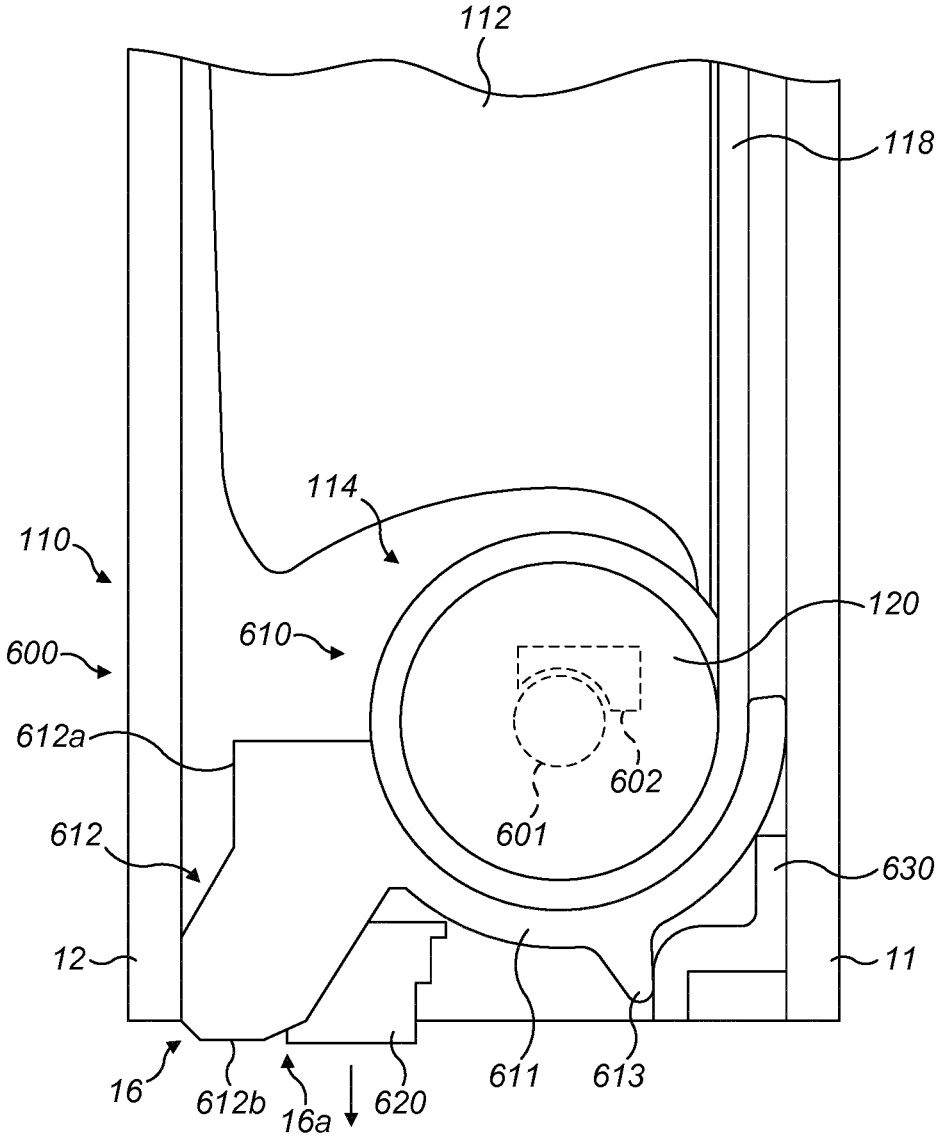
FIGS. 8A to 8D illustrate a sequence of operation of a securing arrangement of the beverage dispensing module of FIG. 1.
Figure 9A:
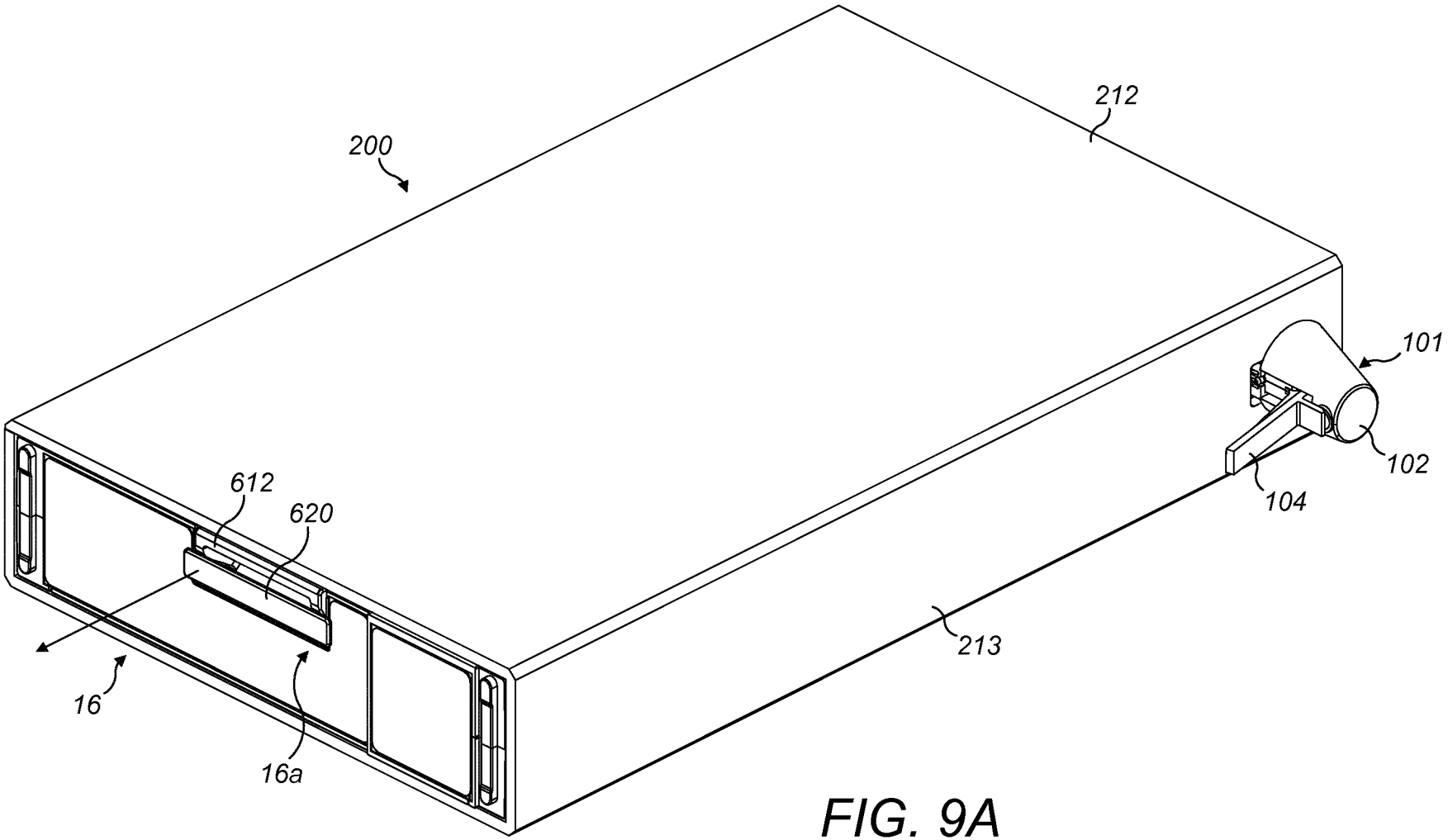
FIGS. 9A to 9C are perspective views illustrating a sequence of operation of the securing arrangement of the beverage dispensing module of FIG. 1.

In FIGS. 8A and 9A, the fixing means 620 is removed from the module 500 by a user pulling it through the opening 16*a* in the bottom wall 16 (in the direction shown by the arrow) with a force that overcomes the retaining force of the temporary locking means. Once the fixing means 620 has been removed, the handle 612 is no longer held in place.

Figure 8B:
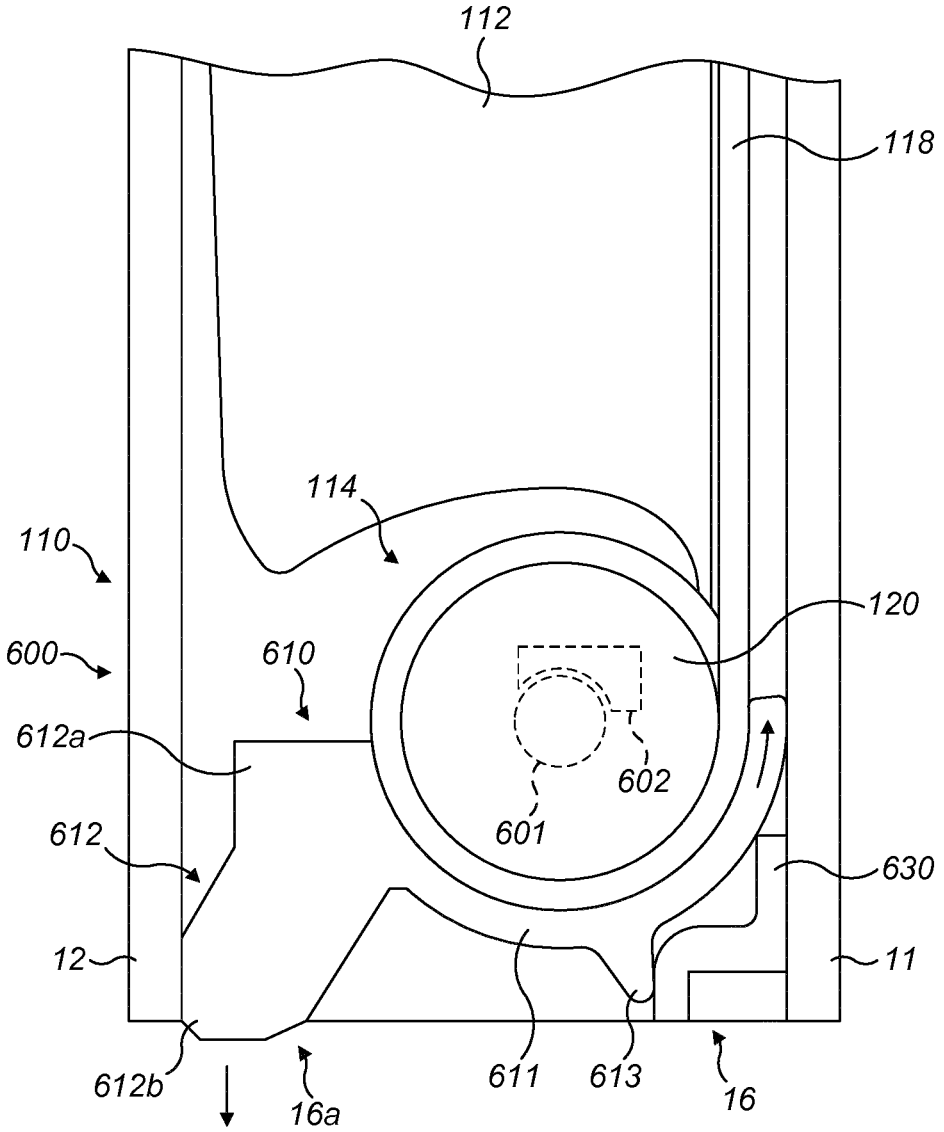
Figure 9B:
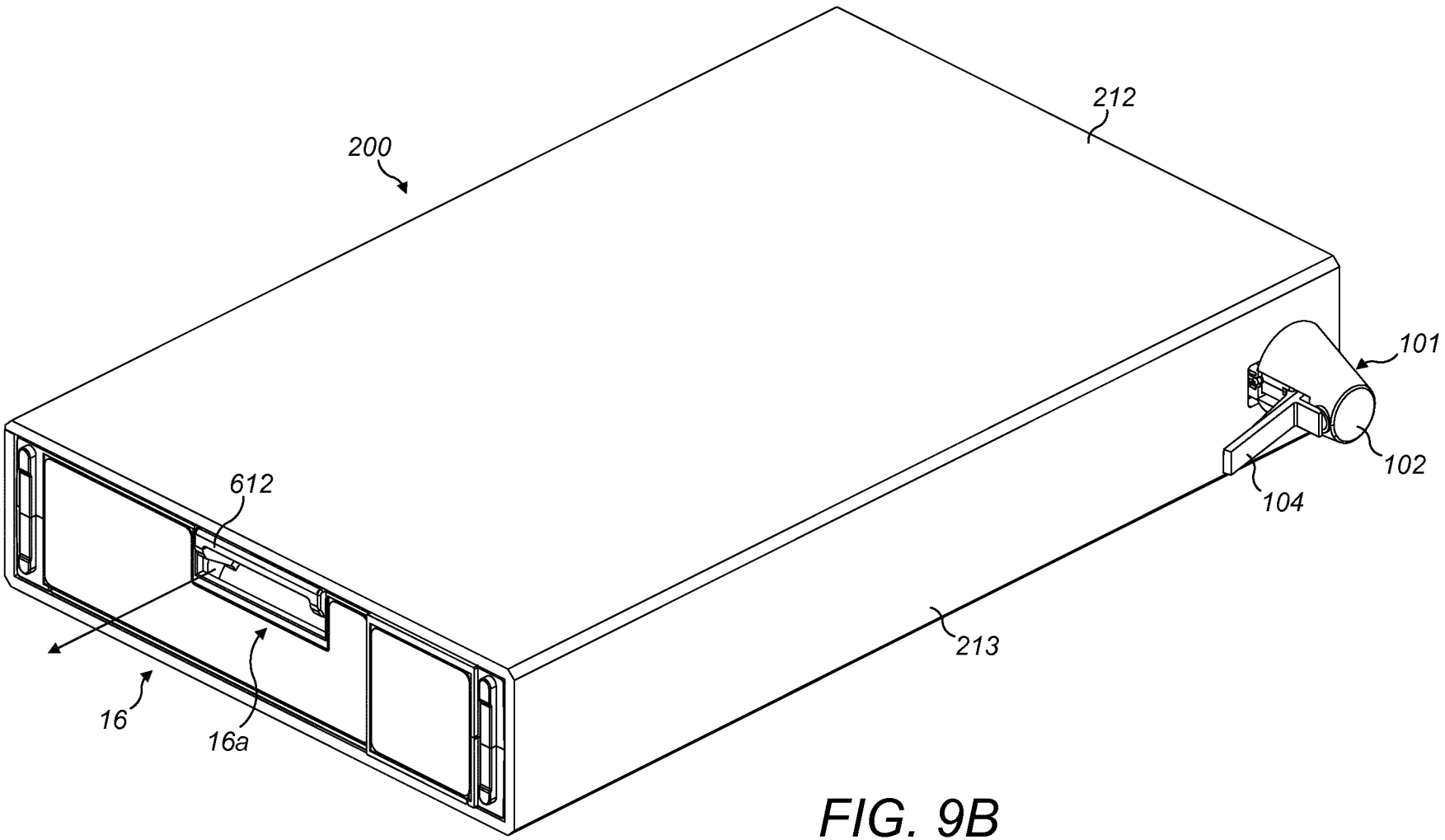

As shown in FIGS. 8B and 9B, the handle 612 may then be and is pulled down through the opening 16*a* in the bottom wall 16. On pulling the handle 612 through the opening 16*a* in the bottom wall 16, the securing device 610 is actuated from the first configuration to the second configuration. Firstly, the handle 612 is pulled through the opening 16*a* in the bottom wall 16, which moves the holding portion 611 towards the bottom wall 16 until the pivot body 613 abuts the bottom wall 16 of the housing 10 and the stop portion 630.

Figure 8C:
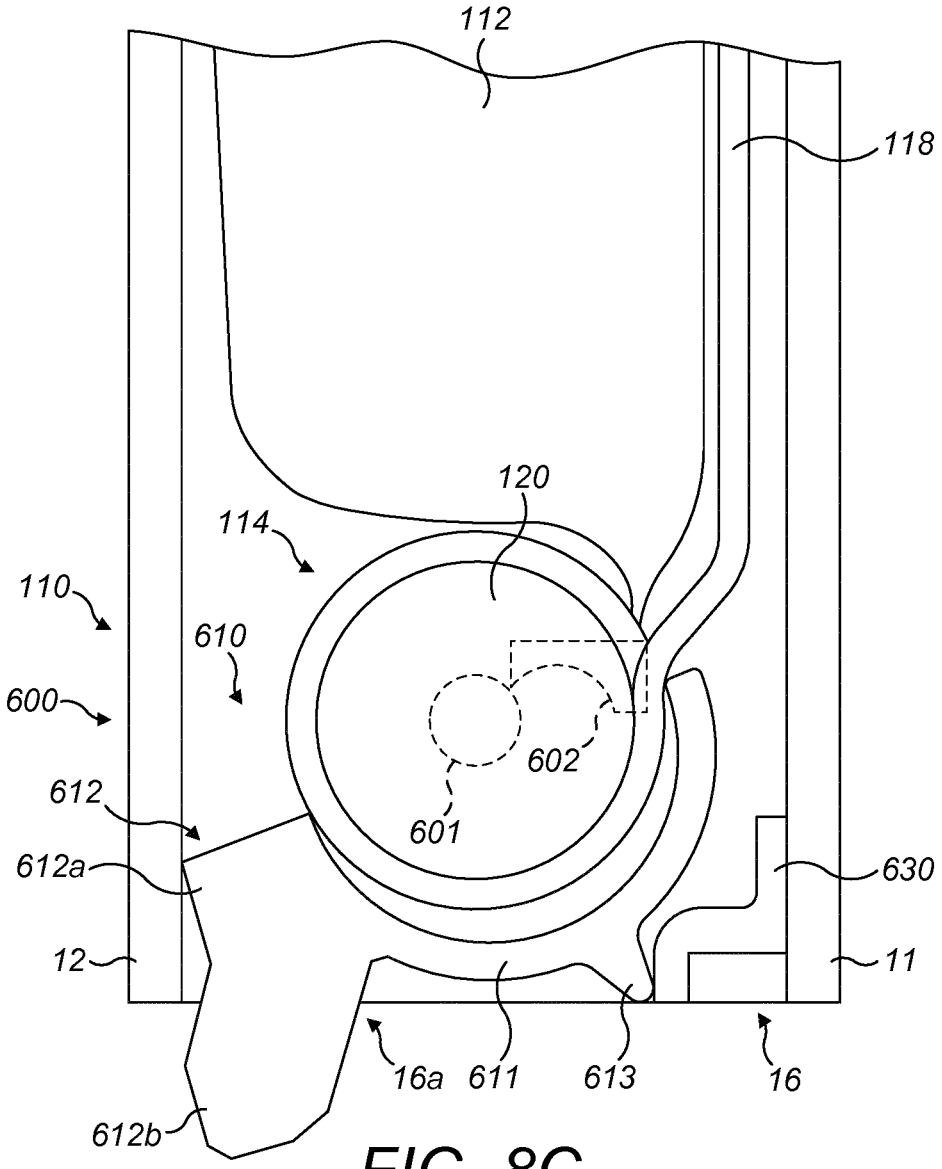
Figure 9C:
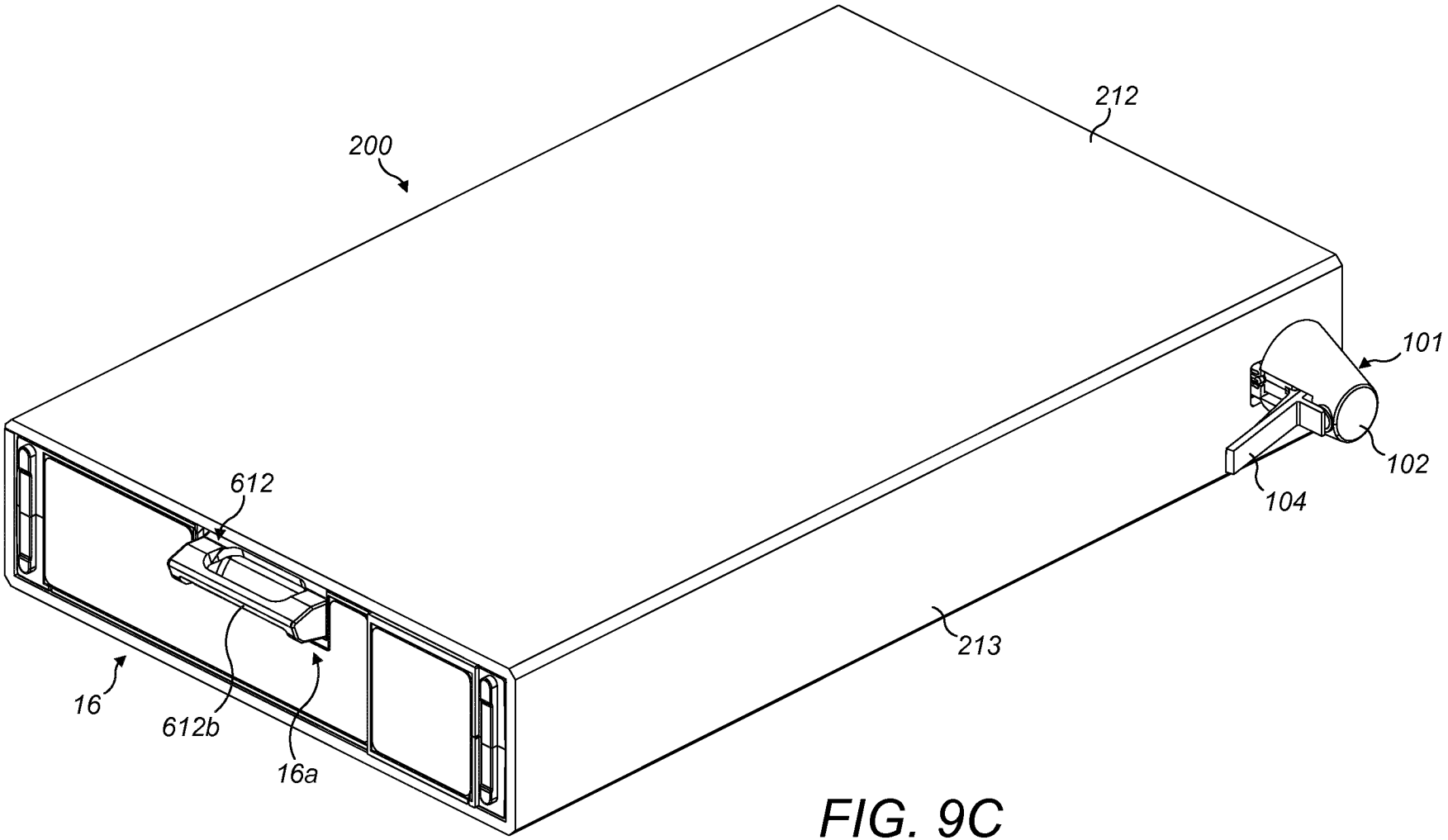

Subsequently, as shown in FIGS. 8C and 9C, the holding portion 611 is rotated about the pivot body 613. The stop portion 630 abuts the holding portion 611 and pivot body 613 at an opposite end thereof to the handle 612 to ensure that the rotation occurs. The force from this rotational movement moves the roller 114 in a direction towards the second major side wall 12, disengaging the first and second engagement means 601, 602. On disengagement of the first and second engagement means 601, 602, the roller 114 is released from the housing 10.

Figure 8D:
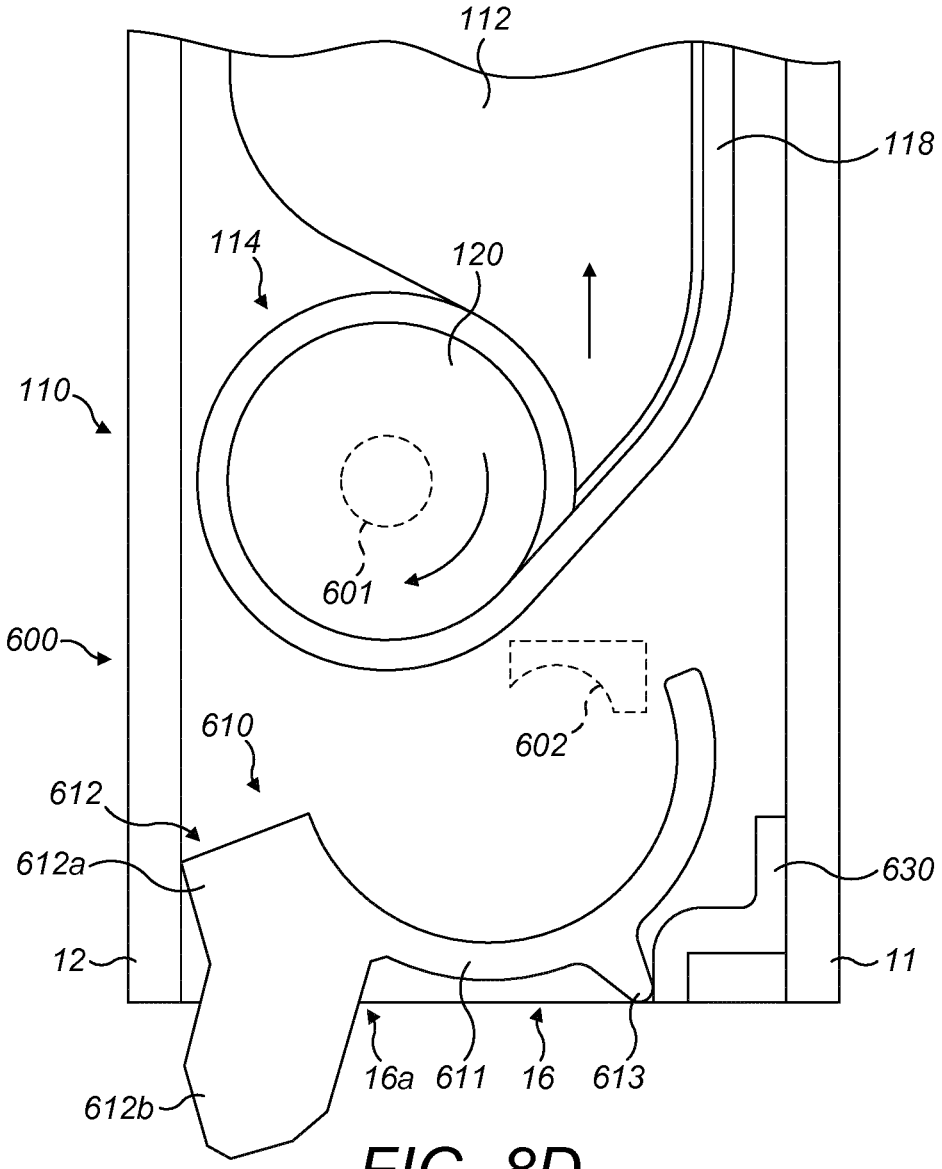

As shown, in FIG. 8D, on release of the roller 114, the roller 114 moves vertically away from the bottom wall 16 of the housing 10 under the force of the roll springs 117, 118. The securing device 610 can subsequently be pushed back through the opening 16*a* to hide it during operation of the module 500.

Thus it will be understood that the securing arrangement 600 secures the roller 114 in the storage position during transport in order to prevent the roller 114 from applying an overpressure to the beverage within the pouch 112. Preferably, the storage position of the roller 114 is adjacent the bottom wall 16 of the housing 10 so that the contents of the pouch 112 are, in that case, not at an overpressure relative to atmosphere. Thus, even if the dispensing actuator 104 is depressed, because the alcoholic beverage is not being urged against the dispensing valve 103, it will not flow out even when that valve 103 is opened. Therefore, accidental activation of the module 500 during transit is avoided.

The consequence of removing the fixing means 620 and pulling the handle 612 away from the module 500 is that the roller 114 becomes released from its storage position and thus moves in a vertical direction until equilibrium is reached between the now slight overpressure on the fluid within the pouch 112 and the resistance to flow provided by the dispensing valve 103 when in a closed position.

The roll springs 117, 118 apply an overpressure relative to atmosphere to the beverage within the pouch 112 by applying a torque to the roller 114. The beverage extends from the internal volume of the pouch 112 (i.e. from between the side panels 201, 202, 203, 204), through a dispensing conduit and to the dispensing valve 103. The dispensing valve 103 may be a ball valve having a handle and pivotable ball comprising a central bore. The handle actuates the dispensing valve 103 between an open configuration and a closed configuration. In the open configuration, the pivotable ball is aligned such that the bore is in-line with flow through the dispensing conduit. In the closed configuration, the pivotable ball is aligned such that the bore is perpendicular to flow through the dispensing conduit.

To dispense the beverage from the module 500, the user actuates the dispensing actuator 104, for example by pressing down on a lever as illustrated in FIG. 1. The dispensing actuator 104 is arranged to exert a force on the handle of the ball valve such that the handle rotates the pivoting ball of the valve ninety degrees thereby actuating the ball valve from the closed configuration to the open configuration. Beverage subsequently flows out of the dispensing valve 103 and out of an opening in the beverage outlet arrangement 101.

As the beverage flows out of the pouch 112 the pressurising means 110 rotates the roller 114 such that pouch 112 wraps around it. Therefore, the internal volume is reduced and an overpressure is maintained in the beverage relative to atmosphere. When the dispensing actuator 104 is released, the dispensing valve 103 closes and beverage no longer flows out of the pouch 112. The beverage applies an opposing force against the torque provided by the resilient bias means 115 such that the roller 114 no longer rotates.

Multiple dispense events may be required until substantially all of the beverage has been dispensed from the module 500. When the internal volume is substantially empty the roller 114 will be located towards the outlet end of the housing 10 and the pouch 112 will almost entirely be wrapped around the roller 114. A user may subsequently disassemble the module 500 and the parts recycled.

By providing the pressurising means 110 and the securing arrangement 600 configured as described above, tamper evidence and anti-counterfeiting can be achieved. This is because the securing arrangement 600 and pressurising means 110 are preferably configured such that returning of the securing device 610 from the second configuration to the first configuration does not result in the returning of the pressurising means 110 to the storage position. More specifically, the release of the roller 114 from the storage position on actuation of the securing device 610 from the first to the second configuration is preferably irreversible. The bottom frame panel 316 is glued or likewise bonded to the bottom minor edges of the major side frame panels 311, 312 and does not comprise any apertures of sufficient size to allow the roller 114 to be manually pulled back into the storage position by a user. Furthermore, even if a user could dismantle the module 500 to restore the roller 114 to the storage position, it would be extremely difficult to hold the roller 114 in the storage position whilst re-inserting the fixing means 620 together with the bottom frame panel 316. This is required to maintain the securing device 610 in the first configuration and so maintain the roller 114 in the storage position. Therefore, there is provided a readily visible, easily detectable method by which users and law enforcement agencies can determine if the module 500 has already been used or tampered. Moreover, the difficulty of resetting the securing arrangement 600 and roller 114 once the securing device 610 has been actuated from the first to the second configuration acts as a deterrent to counterfeiters.

Whilst a number of embodiments have been described, it will be understood that these are for the purposes of illustration only and that the invention is not so limited. The skilled reader will envisage various modifications and alternatives that fall within the scope of the claims.

The housing 10 of the module 500 may be of an alternative configuration compared to those shown in FIGS. 1 to 9. For example, the housing 10 may have another suitable shape, such as a cube or square cuboid. Furthermore, in terms of sustainability of materials, ease of recycling, cost, weight and so forth, it is not essential that the housing 10 be formed of multiple separate or separable parts.

The securing arrangement 600 may be of an alternative configuration compared to those shown in FIGS. 1 to 9. For example, the removable wedge 620 may be replaced with a tab. A first end of the tab may be bonded to the handle 612 using an adhesive or clamped, sealed or sandwiched into the handle 612 as part of the construction of the handle itself. A second end of the tab is likewise bonded or glued to the inside surface of the second major side wall 12 such that it is under tension. The tab comprises a line of weakness between the first and second ends that can be torn, is accessible from outside the housing 10 and is held under tension. During storage and transport of the module 500, the tab is kept in place. When it is desired to use the module 500 for the first time to dispense alcoholic beverage, the line of weakness is torn and the handle 612 released. The handle 612 may subsequently be moved through the opening 16*a* in the bottom wall 16 to actuate the securing device 610 from the first configuration to the second configuration.

The holding portion 611 of the securing device 610 may be of an alternative configuration compared to those shown in FIGS. 1 to 9. In particular, the holding portion 611 may comprise any suitable means or body that exerts a retaining force against a releasing force applied by the pressurising means 110 to release the first and second engagement means 601, 602. For example, the holding portion 611 may extend along at least a portion of or all of the length of the roller 114 in a direction parallel to the major edge of the bottom wall 16. The holding portion 611 may surround less than half the outer circumference of the roller 114.

The roller 114 may be of an alternative configuration compared to those shown in FIGS. 1 to 8. For example, the roller 114 may have any other suitable cross-sectional shape such as square, rectangular, hexagonal, triangular or octagonal. Furthermore, the diameter of the roller 114 may vary along its length, for example by being larger in the centre and decreasing towards the ends of the roller 114.

In the illustrated embodiments, the pouch 112 is attached to the intermediate part 114*b* of the roller 114. Alternatively, the pouch 112 may be attached all the way along the roller 114, or only at the first 120 and second ends 121 of the roller 114 its lower end.

It will be appreciated that there are various other suitable arrangements for the roll springs 117, 118. Only one, or more than two roll springs 117, 118 may be attached between the roller 114 and the top of the housing 10. The roll springs 117, 118 may be any other suitable type of spring, such as spiral or torsion springs. Furthermore, the springs 117 need not be attached to the top of the housing 10 and may instead only be attached to the roller 114.

Instead of a pair of roll springs 117, 118, resilient bias may be applied to the roller 114 by the use of at least one elongate elastic (e.g. elastomeric) member attached to the roller 114 and arranged to induce a torque in the roller 114 such that it rotates. Preferably the roller 114 is substantially hollow and the at least one elastic member extends through it between the minor side walls 13, 14 of the housing 10. The elastic member is helically wound around itself as well as, if present, other elastic members. At least one end of the elastic member(s) is attached to an anchor moveably mounted within the housing 10, for example in one of a vertically running formed slots on the inside of the minor side walls 13, 14 of the housing 10. The anchor prevents one end of the elastic member(s) from unwinding, but enables the elastic member(s) to move upwards with the roller 114. Thus the helical winding of the elastic member(s) will resiliently bias and induce a torque in the roller 114 such that it rotates and wraps the pouch 112 around it when beverage is dispensed from its internal volume.

The elastic member may be formed of polymer, latex, theraband, neoprene, silicone or the like. Preferably the elastic member(s) is maintained within its elastic range between when the pouch 112 is full and when it is empty, such that it always provides a substantially equal compressive force to the pouch 112 over its range of expansion and contraction. It has been found that a circular cross section is particularly suitable for achieving such an effect as it comprises a relatively high number of cross-links in various directions which prevent stress relaxation. This is particularly the case when compared to an elastic member having a substantially planar cross-section.

In an alternative embodiment, first and second elastic members may each be attached at either end 120, 121 of the roller 114 and extend to the top of the housing 10. The tensile force of the at least one elastic strip may resiliently bias the roller 114 into rolling. The at least one elastic band could, for example, be under maximum tension when the pouch 112 is full of beverage and may become progressively less taut as beverage is emptied.

The invention claimed is:

1. A beverage dispensing module, comprising:

a housing;

a beverage container within the housing, the beverage container comprising a flexible pouch;

a beverage outlet arrangement, fluidly coupled with the beverage container;

a dispensing arrangement positioned within the housing, and having a pressurising means for selectively urging beverage from the beverage container and out of the beverage outlet arrangement; the pressurising means including resilient bias means connected to a roller, the roller being attached to the flexible pouch; and a securing arrangement comprising a securing device, the securing device being actuatable between a first configuration, for maintaining the pressurising means in a storage position relative to the beverage container, and a second configuration, for releasing the pressurising means from the storage position.

2. The beverage dispensing module of claim 1, wherein, when the pressurising means is in the storage position, the pressurising means does not apply a pressure to beverage in the beverage container.

3. The beverage dispensing module of claim 1, wherein, when the pressurising means is released from the storage position, the pressurising means applies a pressure to beverage in the beverage container.

4. The beverage dispensing module of claim 1, wherein the securing arrangement and pressurising means are configured such that returning of the securing device from the second configuration to the first configuration does not result in the returning of the pressurising means to the storage position.

5. The beverage dispensing module of claim 1, wherein the securing arrangement and securing device are configured such that the securing device is pivotable about a pivot body, and further wherein the securing device is actuated from the first configuration to the second configuration on pivoting about the pivot body.

6. The beverage dispensing module of claim 1, wherein the securing arrangement comprises first engagement means located on the pressurising means and corresponding second engagement means fixed relative to the housing for holding the pressurising means in the storage position.

7. The beverage dispensing module of claim 1, wherein the securing device comprises a handle extending between a first end proximal to the pressurising means and a second end accessible outside the housing.

8. The beverage dispensing module of claim 1 wherein the securing arrangement comprises removable fixing means configured to maintain the securing device in the first configuration until removed by a user.

9. The beverage dispensing module of claim 8, wherein the fixing means comprises a removable wedge for wedging the securing device in the first configuration, whereby, following removal of the removable wedge, the securing device is actuatable between the first and second configurations.

10. The beverage dispensing module of claim 1 wherein the securing device is configured such that when the securing device is actuated to the second configuration, the pressurising means is released from the storage position and the resilient bias means urges the roller against the pouch so as to create a pressure upon the contents thereof.

11. The beverage dispensing module of claim 1, wherein the resilient bias means comprises or includes one or more springs biased to reduce the internal volume of the pouch by rotating the roller, the pouch being wrapped around the roller as the roller rotates.

12. The beverage dispensing module of claim 1, wherein the securing device comprises a holding portion extending from the handle and configured to surround at least a portion of the roller, further wherein moving the handle from the first configuration to the second configuration moves the holding portion so as to release the roller.

13. The beverage dispensing module of claim 12, wherein the holding portion is semiannular and partially surrounds the outer circumference of the roller, further wherein moving the handle from the first configuration to the second configuration rotates the holding portion so as to release the roller.

14. The beverage dispensing module of claim 1, wherein the beverage outlet arrangement is only manually actuatable.

15. The beverage dispensing module of claim 1, wherein the housing fully encloses the pressurising means.

16. A method of initiating the dispensing of a beverage from a beverage dispensing module, the beverage dispensing module comprising:

a housing;

a beverage container within the housing, the beverage container comprising a flexible pouch;

a beverage outlet arrangement, fluidly coupled with the beverage container;

a dispensing arrangement positioned within the housing, and having a pressurising means for selectively urging beverage from the beverage container and out of the beverage outlet arrangement, the pressurising means including resilient bias means connected to a roller, the roller being attached to the flexible pouch; and a securing arrangement comprising a securing device;

the method comprising actuating the securing device from a first configuration to a second configuration, wherein, when in the first configuration, the pressurising means is maintained in a storage position relative to the beverage container, and, when in the second configuration, the pressurising means is released from the storage position.

17. The method of claim 16, wherein, when the pressurising means is in the storage position, the pressurising means does not apply a pressure to the beverage in the beverage container and when the pressurising means is released from the storage position, the pressurising means applies a pressure to the beverage in the beverage container.

18. The method of claim 16, wherein the step of actuating the securing device from the first configuration to the second configuration comprises pivoting the securing device about a pivot.

* * * * *